US008424677B2

(12) United States Patent
Spivey, Sr. et al.

(10) Patent No.: US 8,424,677 B2
(45) Date of Patent: Apr. 23, 2013

(54) CARTON WITH RETENTION FEATURES

(75) Inventors: Raymond R. Spivey, Sr., Mableton, GA (US); Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 13/283,716

(22) Filed: Oct. 28, 2011

(65) Prior Publication Data

US 2012/0104080 A1 May 3, 2012

Related U.S. Application Data

(60) Provisional application No. 61/456,013, filed on Oct. 29, 2010, provisional application No. 61/574,417, filed on Aug. 2, 2011.

(51) Int. Cl.
*B65D 65/00* (2006.01)
*B65D 75/00* (2006.01)

(52) U.S. Cl.
USPC ..... 206/196; 206/156; 206/434

(58) Field of Classification Search ..... 206/139, 206/140, 156, 157, 162–176, 196, 427, 429, 206/434
See application file for complete search history.

(56) References Cited

U.S. PATENT DOCUMENTS

| | | | | |
|---|---|---|---|---|
| 1,968,877 A | | 8/1934 | Cubberley | |
| 2,345,567 A | * | 4/1944 | Arneson | 206/176 |
| 2,384,480 A | * | 9/1945 | Lupton | 206/196 |
| 2,417,421 A | | 3/1947 | Koolnis | |
| 2,522,950 A | | 9/1950 | Keith | |
| 2,558,618 A | * | 6/1951 | Lebold | 206/196 |
| 2,563,065 A | * | 8/1951 | Price | 206/171 |
| 2,804,234 A | | 8/1957 | Lachance | |
| 2,950,854 A | * | 8/1960 | Ganz | 206/196 |
| 3,355,012 A | | 11/1967 | Weiss | |
| 3,386,570 A | | 6/1968 | Lock | |
| 3,670,950 A | | 6/1972 | Rossi | |

(Continued)

FOREIGN PATENT DOCUMENTS

| | | |
|---|---|---|
| AR | 78777 | 12/2008 |
| EP | 1 348 638 A1 | 10/2003 |
| GB | 2 279 065 A | 12/1994 |

OTHER PUBLICATIONS

International Search Report and Written Opinion for PCT/US2011/058221 dated May 21, 2012.

*Primary Examiner* — Bryon Gehman
(74) *Attorney, Agent, or Firm* — Womble Carlyle Sandridge & Rice, LLP

(57) ABSTRACT

A carton for carrying a plurality of articles that includes a top panel and at least one side panel foldably connected to the top panel. The least one side panel has a first retention feature for retaining a first portion of at least one of the plurality of articles, and a second retention feature for retaining a second portion of the at least one of the plurality of articles. The first retention feature comprises at least two first openings and the second retention feature is spaced apart from the first retention feature. The second retention feature comprises at least two second openings respectively aligned with a respective one of the at least two first openings, and at least two retention flaps foldably connected at a respective fold line. The at least two retention flaps are positioned between the at least two second openings.

34 Claims, 14 Drawing Sheets

U.S. PATENT DOCUMENTS 3,744,704 A 7/1973 Struble
3,820,657 A 6/1974 Klygis et al.
3,884,353 A 5/1975 Forte
4,101,069 A 7/1978 Wood
4,146,168 A 3/1979 Hartline
4,424,901 A 1/1984 Lanier
4,533,047 A 8/1985 Calvert
4,601,390 A * 7/1986 Rosenthal et al. ..... 206/175
4,708,284 A 11/1987 Sutherland et al.
5,167,325 A 12/1992 Skora
5,437,363 A * 8/1995 Gungner ..... 206/140
5,485,915 A 1/1996 Harris
5,549,197 A 8/1996 Sutherland
5,595,291 A 1/1997 Negelen
6,695,137 B2 2/2004 Jones et al.
6,896,130 B2 5/2005 Theelen
7,374,038 B2 5/2008 Smalley

* cited by examiner

CARTON WITH RETENTION FEATURES

CROSS REFERENCE TO RELATED APPLICATIONS

This application claims the benefit of U.S. Provisional Application No. 61/456,013, filed Oct. 29, 2010, and U.S. Provisional Patent Application No. 61/574,417, filed Aug. 2, 2011.

INCORPORATION BY REFERENCE

The entire contents of U.S. Provisional Patent Application No. 61/456,013, filed Oct. 29, 2010, and U.S. Provisional Patent Application No. 61/574,417, filed Aug. 2, 2011, are incorporated by reference herein for all purposes.

BACKGROUND OF THE DISCLOSURE

The present disclosure generally relates to carriers for holding and dispensing beverage containers or other types of articles.

SUMMARY OF THE DISCLOSURE

In one aspect, the disclosure is generally directed to a carton for carrying a plurality of articles. The carton comprises a top panel, and at least one side panel foldably connected to the top panel. The least one side panel has a first retention feature for retaining a first portion of at least one of the plurality of articles, and a second retention feature for retaining a second portion of the at least one of the plurality of articles. The first retention feature comprises at least two first openings and the second retention feature is spaced apart from the first retention feature. The second retention feature comprises at least two second openings respectively aligned with a respective one of the at least two first openings, and at least two retention flaps are foldably connected at a respective fold line. The at least two retention flaps are positioned between the at least two second openings.

In another aspect, the disclosure is generally directed to a blank for forming a carton for carrying a plurality of articles. The blank comprises a top panel; and at least one side panel foldably connected to the top panel. The least one side panel has a first retention feature for retaining a first portion of at least one of the plurality of articles in the carton formed from the blank, and a second retention feature for retaining a second portion of the at least one of the plurality of articles in the carton formed from the blank. The first retention feature comprises at least two first openings and the second retention feature is spaced apart from the first retention feature. The second retention feature comprises at least two second openings respectively aligned with a respective one of the at least two first openings, and at least two retention flaps are foldably connected at a respective fold line. The at least two retention flaps are positioned between the at least two second openings.

In another aspect, the disclosure is directed to a method of forming a carton for carrying a plurality of articles. The method comprises obtaining a blank comprising a top panel and at least one side panel foldably connected to the top panel. The least one side panel has a first retention feature for retaining a first portion of a respective article of the plurality of articles, and a second retention feature for retaining a second portion of a respective article of the plurality of articles. The first retention feature comprises at least two first openings and the second retention feature is spaced apart from the first retention feature. The second retention feature comprises at least two second openings respectively aligned with a respective one of the at least two second openings. The at least two retention flaps are foldably connected at a respective fold line and are positioned between the at least two first openings. The method comprises forming the blank into the carton by positioning the side panel relative to the top panel. The forming the carton comprising placing a respective article in a respective one of the at least two first openings and the aligned at least two second openings such that each respective article is retained by the first retention feature and the second retention feature. The at least two retention flaps being positioned between the at least two articles.

In another aspect, the top panel of the carton has an article retaining feature for retaining a top portion of the at least one of the plurality of articles.

In another aspect, the disclosure is generally directed to a blank for forming a carton for holding a plurality of articles.

In another aspect, the disclosure is generally directed to a method of forming a carton from a blank.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons or carriers that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers as disposed within the carrier embodiments. In this specification, the terms "lower," "bottom," "upper" and "top" indicate orientations determined in relation to fully erected and upright cartons.

Figure 1:
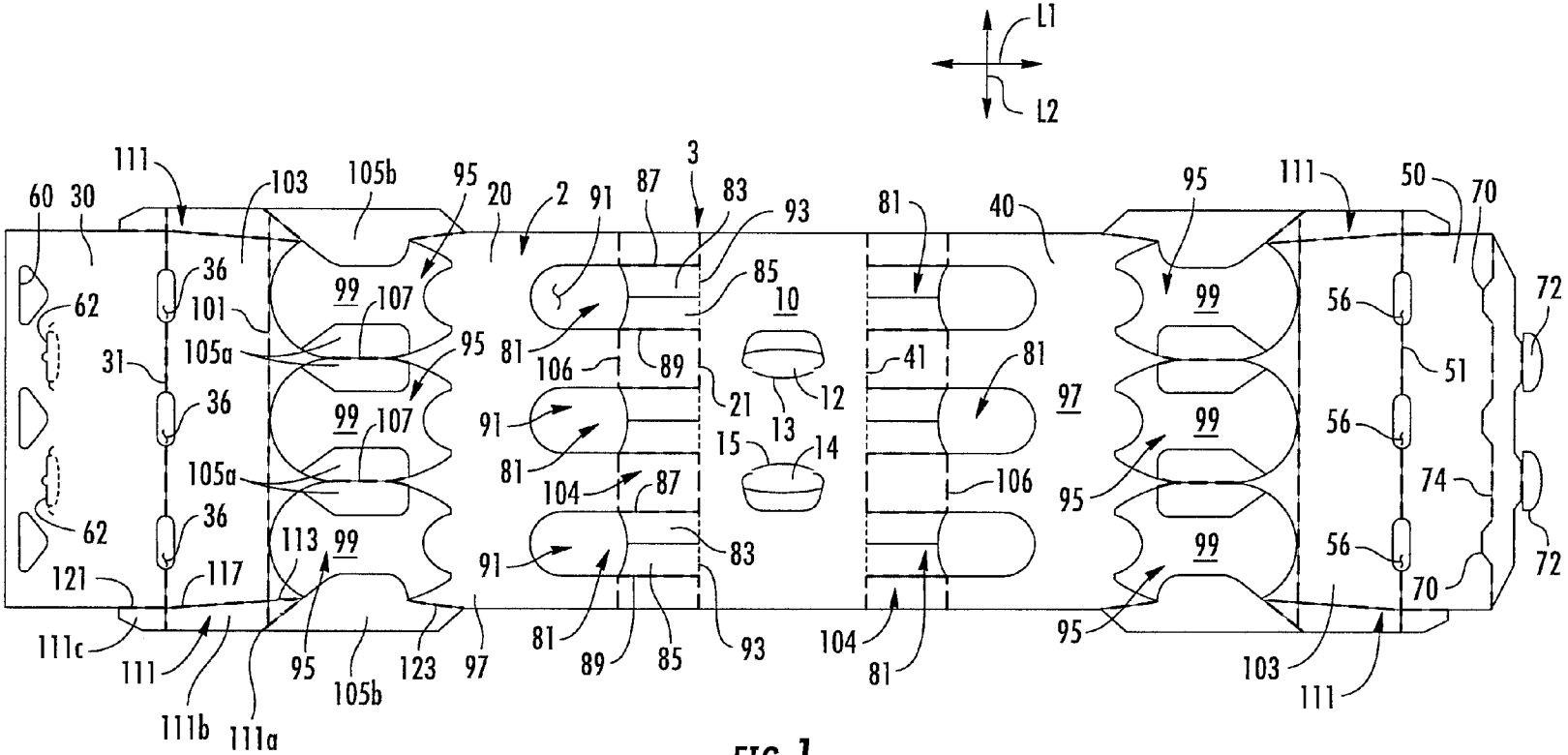
FIG. 1 is a plan view of an exterior surface of a blank for forming a carton according to a first embodiment of the disclosure.
Figure 2:
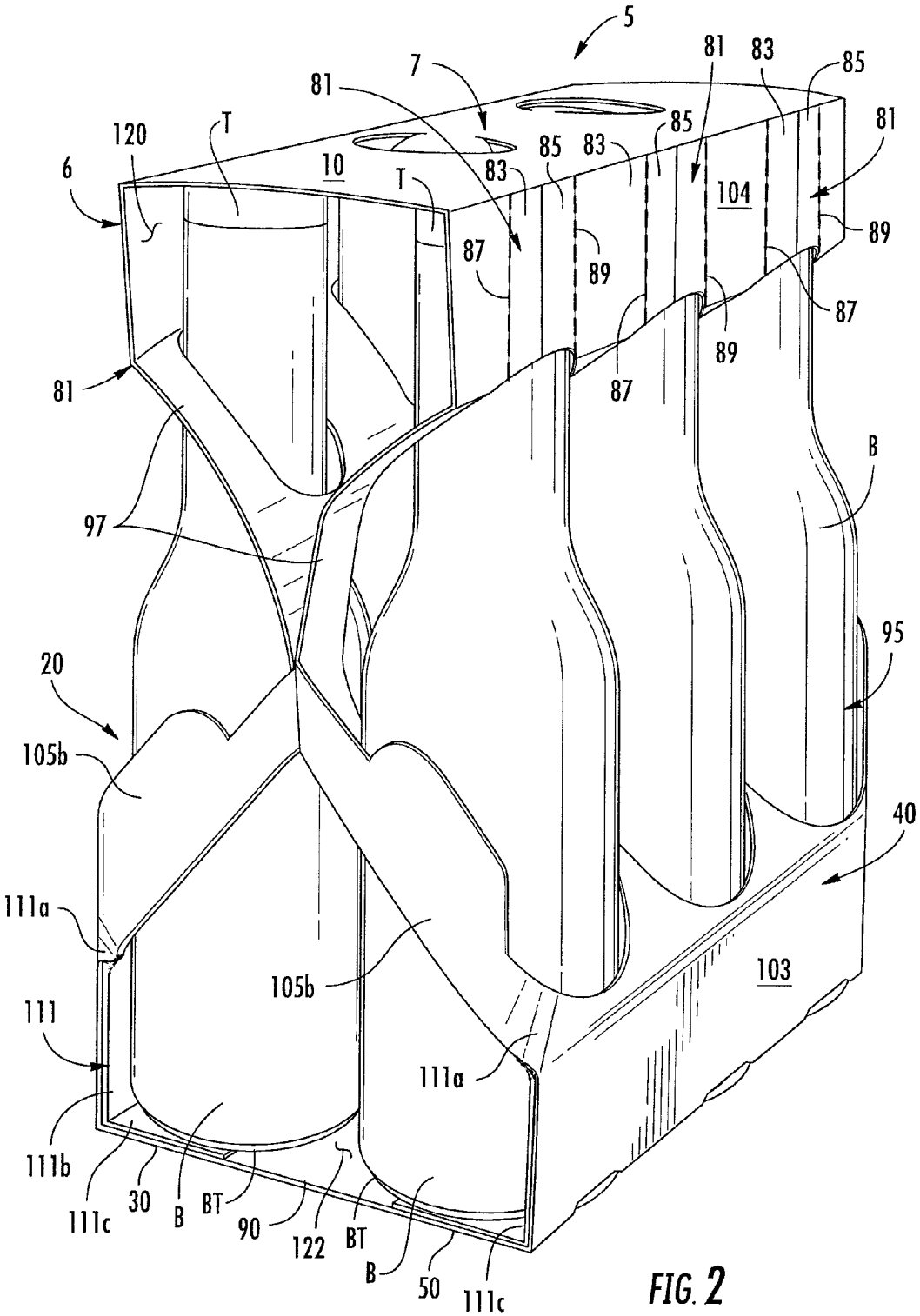
FIG. 2 is a perspective view of the carton of the first embodiment.

FIG. 1 is a plan view of an exterior surface 2 of a blank 3, used to form a carton or carrier 5 (FIG. 4) according to a first embodiment of the disclosure. The carton 5 can be used to house a plurality of articles such as containers B (FIG. 2). In the illustrated embodiment, the containers B are beverage bottles and the carton 5 is sized to house six containers in a single layer in a 2×3 arrangement. But, it is understood that the carton 5 may be sized and shaped to hold containers B of a different or same quantity in more than one layer and/or in different row/column arrangements (e.g., 1×6, 2×6, 2×4, 2×2, 2×6×2, 2×4×2, 2×9, etc.). In the illustrated embodiment, the carton 5 is a carrier having generally open ends 6, 8 (FIG. 2). The carton 5 could be otherwise shaped and arranged such the ends 6, 8 are at least partially closed such as by end flaps (not shown) or other closing mechanisms.

The blank 3 has a longitudinal axis L1 and a lateral axis L2. In the illustrated embodiment, the blank 3 comprises a top panel 10 foldably connected to a first side panel 20 at a first lateral fold line 21, a first bottom panel 30 foldably connected to the first side panel 20 at a second lateral fold line 31, a second side panel 40 foldably connected to the top panel 10 at a third lateral fold line 41, and a second bottom panel 50 foldably connected to the second side panel 40 at a fourth lateral fold line 51.

The first bottom panel 30, which is the inner bottom panel flap in the assembled carton 5, includes cutouts forming primary female locking edges 60 that are shaped and positioned to engage primary male locking tab projections 70 on the second bottom panel 50. The first bottom panel 30 also includes slits 62 shaped and positioned to receive outer secondary locking tab projections 72 of the second bottom panel 50. The second bottom panel 50, which is the outer bottom panel in the completed carton 5, includes a lateral fold line 74 which is interrupted by the slits that define the primary male locking tab projections 70. Although the locking elements of the blank 3 are illustrated to demonstrate a typical bottom panel locking arrangement suitable for use with the carton 5 (FIG. 2), it is understood that any alternative form of bottom panel locking structure may be employed without departing from the disclosure.

In one embodiment, the blank 3 includes heel cutouts 36 that are aligned with the lateral fold line 31. Similarly, heel cutouts 56 are aligned with the lateral fold line 51. In FIG. 1, the blank 3 includes three heel cutouts 36, 56 in each bottom panel 30, 50, which are arranged to accommodate the six containers B in a 2×3 (two columns and three rows) arrangement. Alternatively, the heel cutouts 36, 56 may be otherwise arranged and positioned in the blank, or the heel cutouts may be omitted without departing from the scope of the disclosure.

As shown in FIG. 1, the blank 3 includes handle features for forming a handle 7 in the carton 5. The handle features include a first handle flap 12 and a second handle flap 14, each respectively formed by slits and foldably attached to the top panel 10 at respective fold lines 13, 15. The handle 7 could include other features for carrying the carton 5, the handle flaps 12, 14 could be omitted or otherwise shaped and arranged, or the handle 7 could be omitted from the carton.

In the illustrated embodiment, the first side panel 20 and the second side panel 40 have generally similar features and are in mirror-image relationship to each other. Accordingly, like or similar features are shown with like or similar reference numbers. As shown in FIG. 1, the first side panel 20 has a first plurality of retention features 81 that are adjacent the fold line 21. Each of the retention features 81 comprises a pair of dispenser flaps 83, 85 respectively foldably connected to the first side panel 20 at a respective longitudinal fold line 87, 89, and an opening 91 (broadly "first openings") adjacent the dispenser flaps. The dispenser flaps 83, 85 are further at least partially defined by a tear line 93 aligned with and forming a portion of the fold line 21.

In the illustrated embodiment, the first side panel 20 has a second plurality of retention features 95 that are spaced apart from the first plurality of retention features 81 by an intermediate portion 97 of the first side panel. Each of the second retention features 95 comprises an opening 99 (broadly "second openings") for receiving a bottom portion of a container B. The openings 99 are adjacent a lateral fold line 101 that connects the intermediate portion 97 to a lower portion 103 of the first side panel 20. Each of the side panels 20, 40 comprises an upper portion 104 that is foldably connected to the intermediate portion 97 at a lateral fold line 106. Each of the second retention features 95 comprises inner retention flaps 105*a* and outer retention flaps 105*b*. The four inner retention flaps 105*a* comprise two pairs of retention flaps, with each flap of the pair being foldably connected at a respective longitudinal fold line 107. Each pair of retention flaps 105*a* is positioned between two adjacent openings 99.

In one embodiment, the two outer retention flaps 105*b* are foldably connected to a lower tuck-in flap 111. Each tuck in flap has a first portion 111*a* foldably connected to the intermediate portion 97 of the side panel 20 at a fold line 113 and foldably connected to the outermost retention flap 105*b* at a fold line 115, a second portion 111*b* foldably connected to the lower portion 103 of the side panel 20 at a fold line 117, and a third portion 111*c* foldably connected to the bottom panel 30, 50 at a fold line 121. The retention flaps 105*b* are each foldably connected to the intermediate portion 97 at a fold line 123 and to the lower tuck-in flap 111 at the fold line 115. Each of the tuck-in flaps 111 and the retention flaps 105*b* could be otherwise shaped, arranged, and/or configured without departing from the disclosure.

Figure 3:
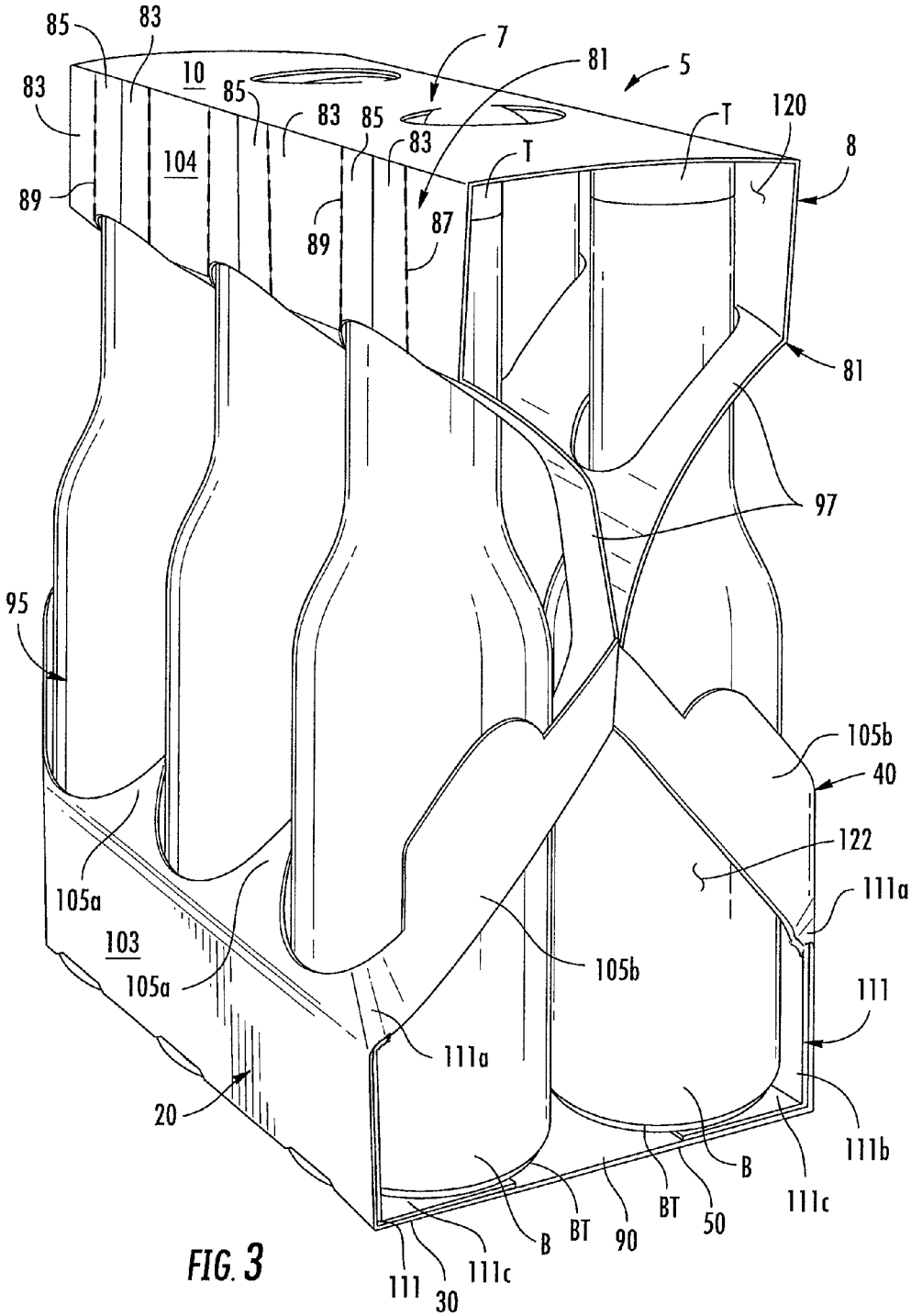
FIG. 3 is a perspective view of the carton of the first embodiment.
Figure 4:
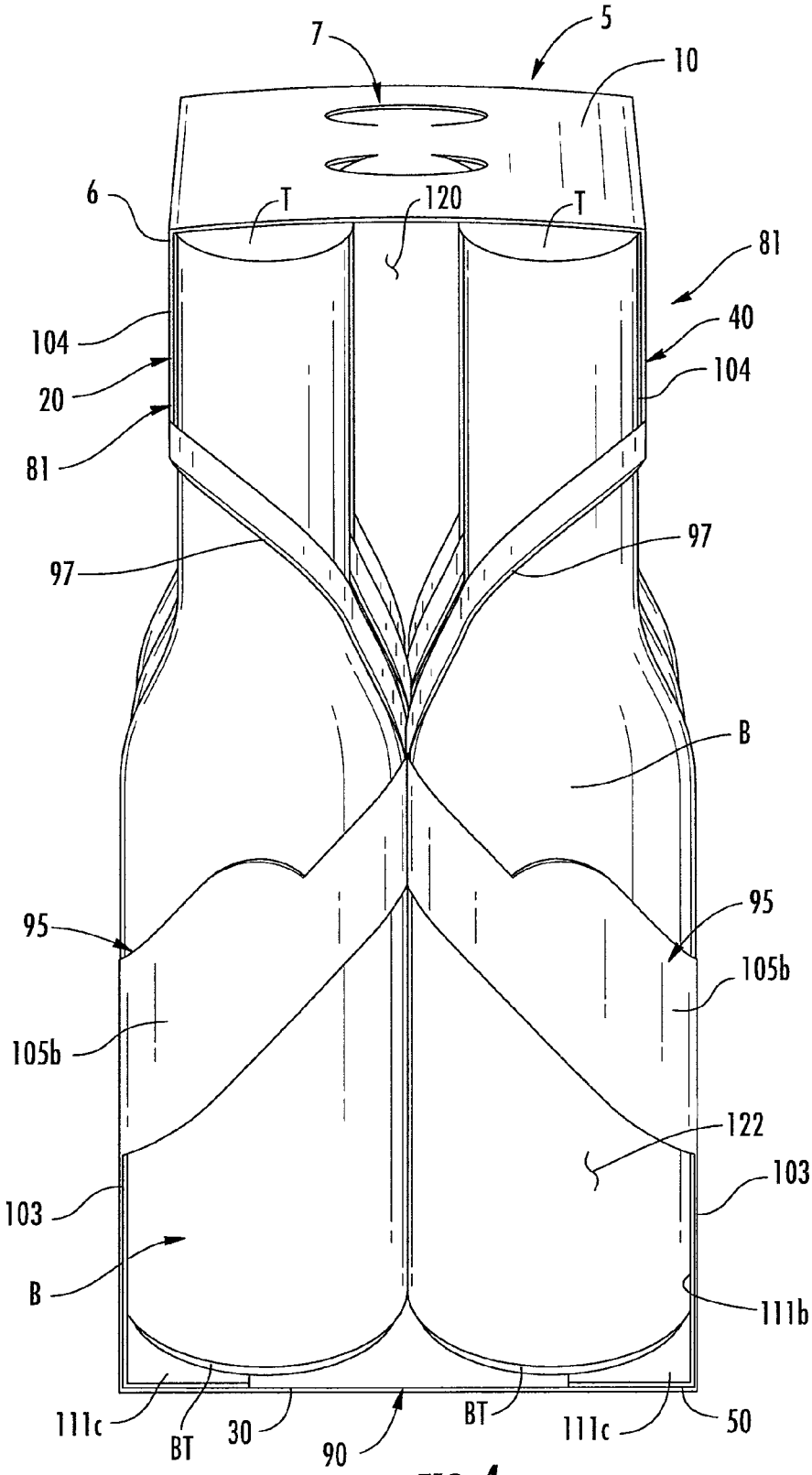
FIG. 4 is an end view of the carton of the first embodiment.
Figure 4A:
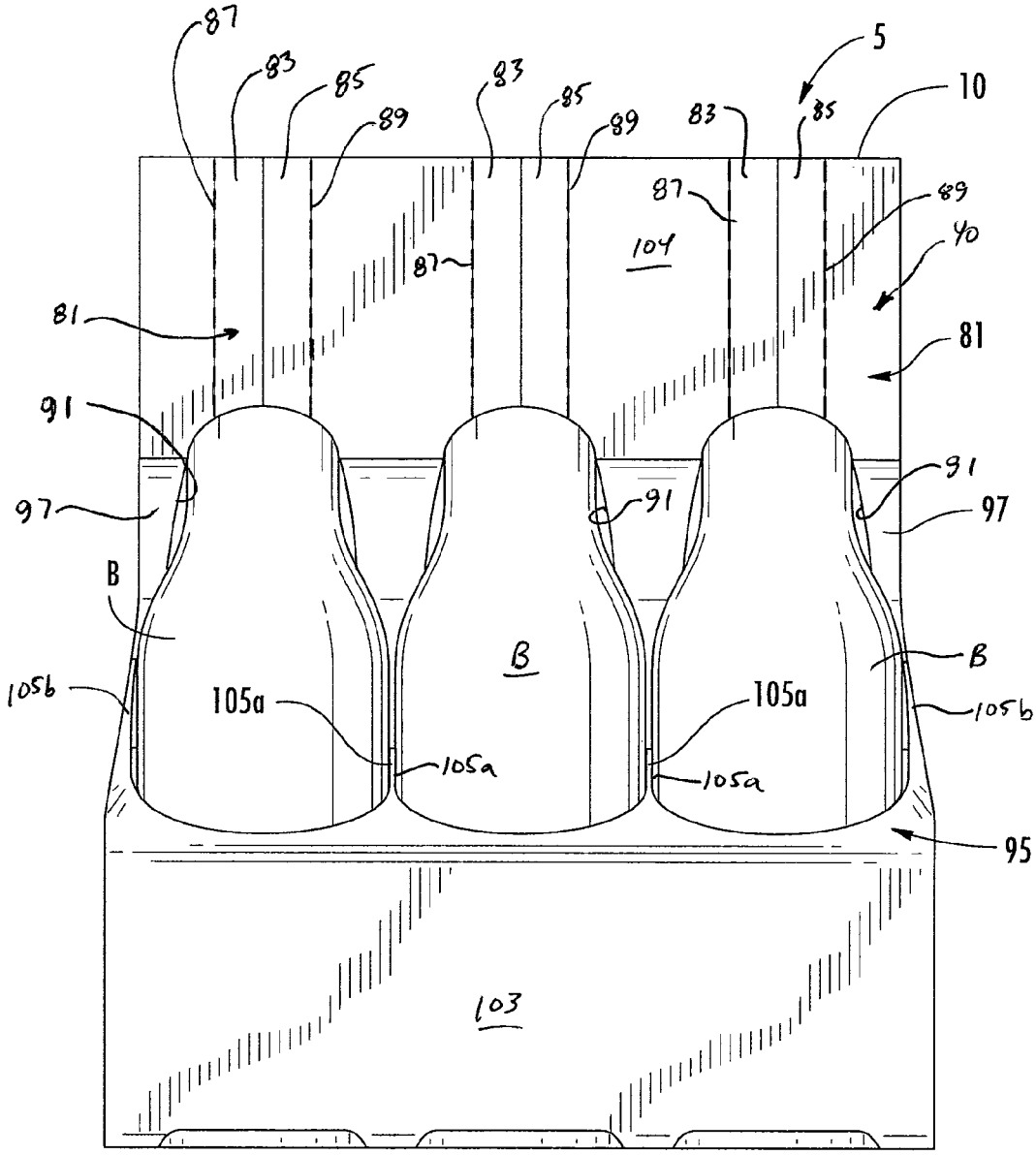
FIG. 4A is a side view of the carton of the first embodiment.

In an exemplary method of erecting the carton 5, the blank 3 can formed around the containers B in a manner such that a respective container is inserted through an opening 99 of one of the bottom retention features 95, and the top portion of the same container is inserted through a respective opening 91 of an adjacent one of the top retention features 81. As shown in FIGS. 2-4, the intermediate portions 97 of the first and second side panels 20, 40 are located adjacent the interior side of the two adjacent rows of containers B and can be at least partially in face-to-face contact. The upper portions 104 and the lower portions 103 of the side panels 20, 40 are located adjacent the exterior side of the two adjacent rows of containers B to hold the containers in the carton 5. Further, the upper portions 104 and the lower portions 103 of a respective side panel 20, 40 are generally coplanar at a respective front and back of the carton 5. The intermediate portion 97 of each side panel 20, 40 extends concavely between the upper and lower portions 103, 104 such that the intermediate portion curves inwardly at the front and back of the carton. In one embodiment, the two concavely curved intermediate portions 97 meet and are in contact at the middle of the carton 5 between the two rows of containers C.

In the illustrated embodiment, when the outer containers B of each row are inserted through the openings 99, the retention flaps 105*b* are upwardly folded and the tuck-in panels 111 are folded to be in face-to-face contact with the side panels 20, 40 and the bottom panels 30, 50. Further, the insertion of the containers through the openings 99 causes the inner pairs of retention flaps 105*a* to upwardly fold at fold line 107. The middle container B has two layers of material in the form of upwardly folded retention flaps 105*a* that can be in face-to-face contact with an adjacent retention flap on either side of the container to provide a cushion or bumper that prevents contact between adjacent containers. The outer retention flaps 105*b* provide a cushion or bumper that protects against contact with the end containers B of adjacent cartons 5 such as when adjacent cartons are moved on a conveyor belt of a packaging line.

In one embodiment, the second bottom panel 50 is secured to the first bottom panel 30 by first respectively engaging primary male locking tabs 70 with the primary female locking edges 60. The male locking flaps 72 are respectively inserted through, and cooperatively interact with, the slits 62 to further secure the second bottom panel 50 to the first bottom panel 30. The secured together bottom panels 30, 50 cooperate to form a bottom panel 90 of the carton 5. The heels of containers B are respectively associated with the cutouts 36, 56 to allow tight wrapping of the carton 5 around containers B. In the illustrated embodiment, the bottoms of the containers B are supported by the overlapped bottom panels 30, 50 that are interlocked to form the bottom and the carton 5. The two outer containers B are in contact with the bottom portion 111*c* of the tuck-in panel 111 to hold the tuck-in panel in place. Alternatively, the tuck-in panel 111 can be adhesively secured to the inner surface of the blank 3.

As shown in FIGS. 2-4A, the upper portions 104 of the side panels 20, 40 cooperate with the top panel 10 to form and partially enclose an upper interior 120 of the carton 5. In the first embodiment, the tops T of the containers B are adjacent to, or in contact with, an inner surface of the top panel 10. The lower portions 103 of the side panels 20, 40 cooperate with the overlapped and locked bottom panels 30, 50 to form and partially enclose a lower interior 122 of the carton 5. In the first embodiment, the bottoms BT of the containers B are adjacent to, or in contact with, an inner surface of the bottom panels 30, 50. The upper portions 104, intermediate portions 97, and lower portions 103 of the side panels 20, 40 could be otherwise shaped, arranged, and/positioned without departing from the disclosure.

The upper retention features 81 of the carton 5 hold the upper portion of the containers B and the lower retention features 95 hold the lower portion of the containers so the containers are held firmly in the carton. The middle portion of the containers B is positioned so that information (e.g., label) on the middle portion of the containers is visible when the containers are held in the carton 5. The containers B could be otherwise positioned in the carton without departing from the disclosure. Further, the carton 5 could be formed by other or different steps of forming or positioning the blank 3 without departing from the disclosure.

In one embodiment, one or more of the containers B can be removed from the carton 5 by pulling the top T of the container outwardly forcing the flaps 83, 85 of the upper retention features 81 to fold outwardly and tear along tear lines 93 to create an opening in the upper retention features. The containers B can be tilted outward away from the interior of the retention features 81 and lifted or raised from the bottom retention features 95 so that the lower portion of the containers are removed from the openings 99. The containers B can be removed or dispensed from the carton 5 by other steps or the carton can have other features for facilitating dispensing or removal of the containers from the carton without departing from the disclosure.

Figure 5:
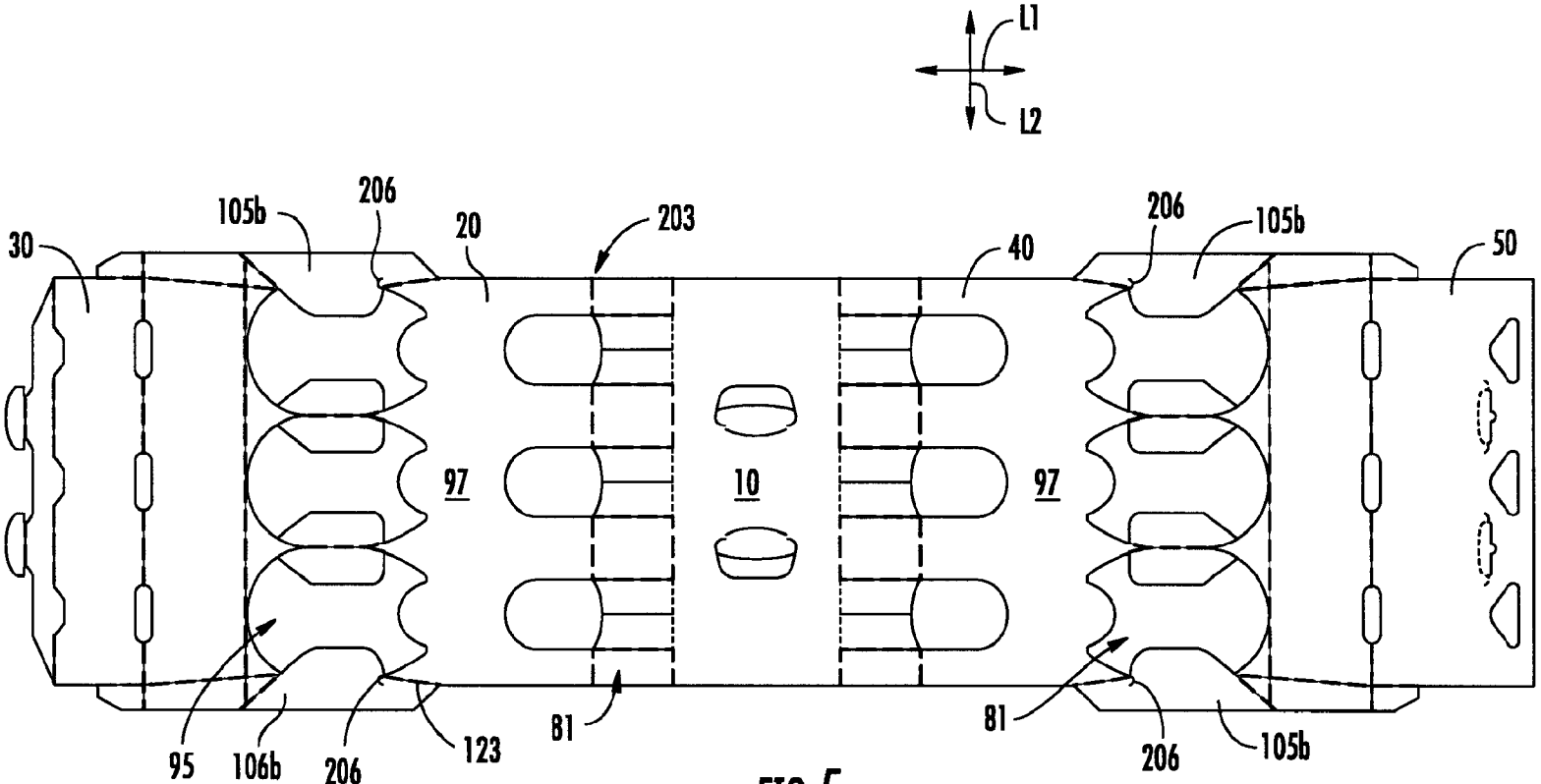
FIG. 5 is a plan view of an exterior surface of a blank for forming a carton according to a second embodiment of the disclosure.
Figure 8:
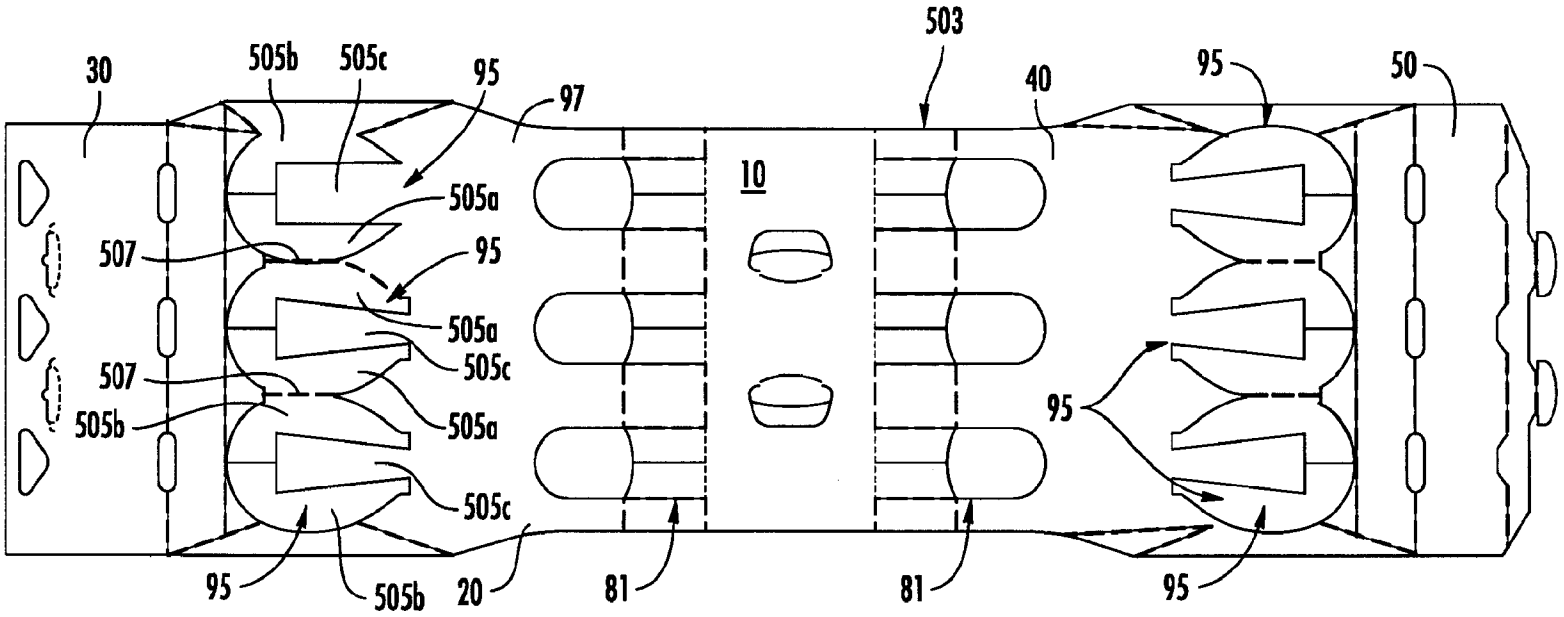
FIG. 8 is a plan view of an exterior surface of a blank for forming a carton according to a fifth embodiment of the disclosure.

FIG. 5 illustrates a blank 203 used to form a carton according to a second embodiment of the present disclosure. The second embodiment is like the first embodiment shown and described with reference to FIGS. 1-4, except for variations noted and other variations that would be apparent to one of ordinary skill in the art. In the embodiment of FIG. 8, like reference numbers as to the reference numbers shown in FIG. 1 indicate like or similar elements. The blank 203 includes hook cuts 206 at the end of each of the fold lines 123 that connect each of the retention flaps 105*b* to a respective side panel 20, 40. The hook cuts 206 facilitate folding of the retention flaps 105*b* relative to the central portion 97 of the side panels 20, 40.

Figure 6:
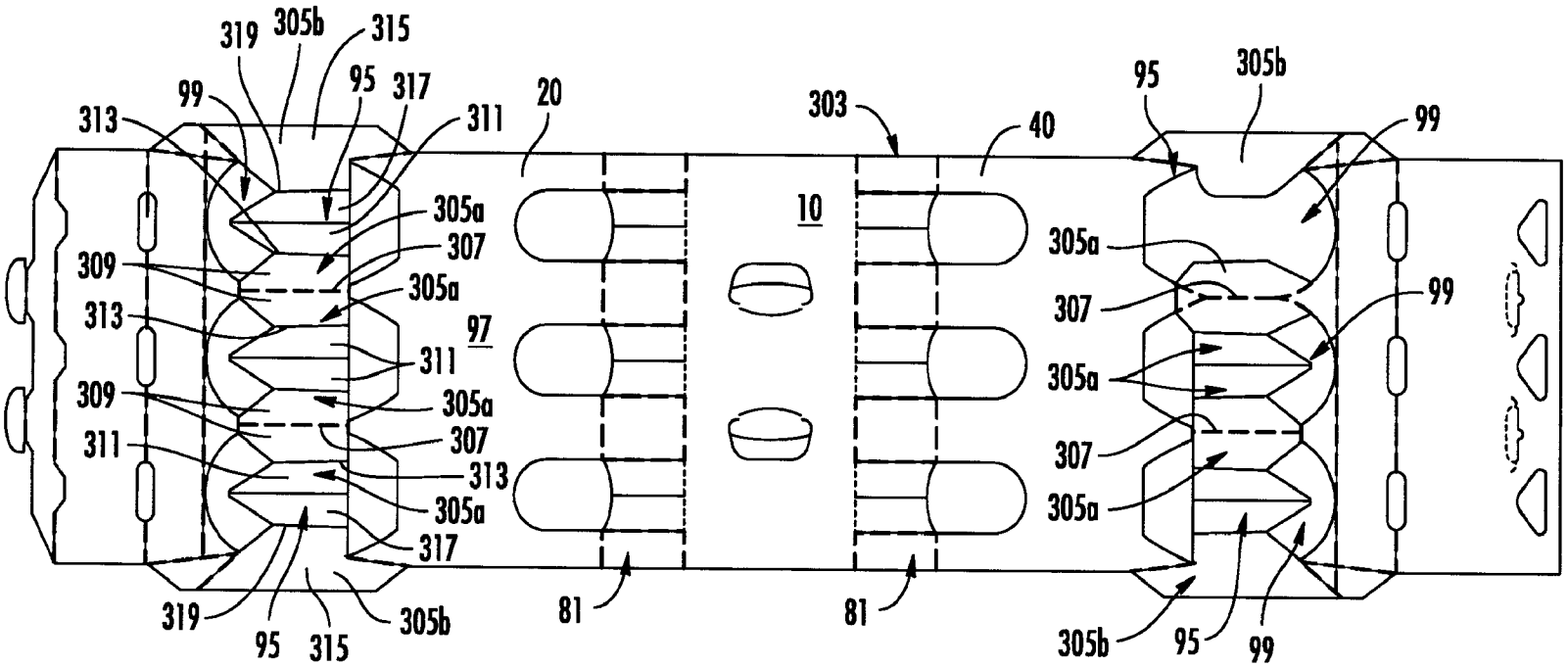
FIG. 6 is a plan view of an exterior surface of a blank for forming a carton according to a third embodiment of the disclosure.

FIG. 6 illustrates a blank 303 used to form a carton according to a third embodiment of the present disclosure. The third embodiment is like the first embodiment shown and described with reference to FIGS. 1-4, except for variations noted and other variations that would be apparent to one of ordinary skill in the art. In FIG. 6, like reference numbers as to the reference numbers shown in FIG. 1 indicate like or similar elements. The blank 303 includes upper retention features 81 that are similar or identical to the upper retention features of the first embodiment. The lower retention features 95 of first side panel 20 of the third embodiment each include inner retention flaps 305*a* and outer retention flaps 305*b*. The four inner retention flaps 305*b* are foldably connected to the blank 303 at respective fold lines 307. In the illustrated embodiment, each of the inner retention flaps 305*a* has a base portion 309 foldably connected at the fold line 307 and a distal portion 311 foldably connected to the base portion at a fold line 313. Further each of the outer retention flaps 305*b* can include a base portion 315 and a distal portion 317 foldably connected to the base portion at a fold line 319 and that is adjacent a respective distal portion 311 of the retention flaps 305*a*. The lower retention features 95 of the second side panel 40 can be similar to the lower retention features of the first side panel 20 or the lower retention features 95 of the second side panel can be similar to the retention features of any of the other embodiments described herein without departing from the disclosure.

Figure 7:
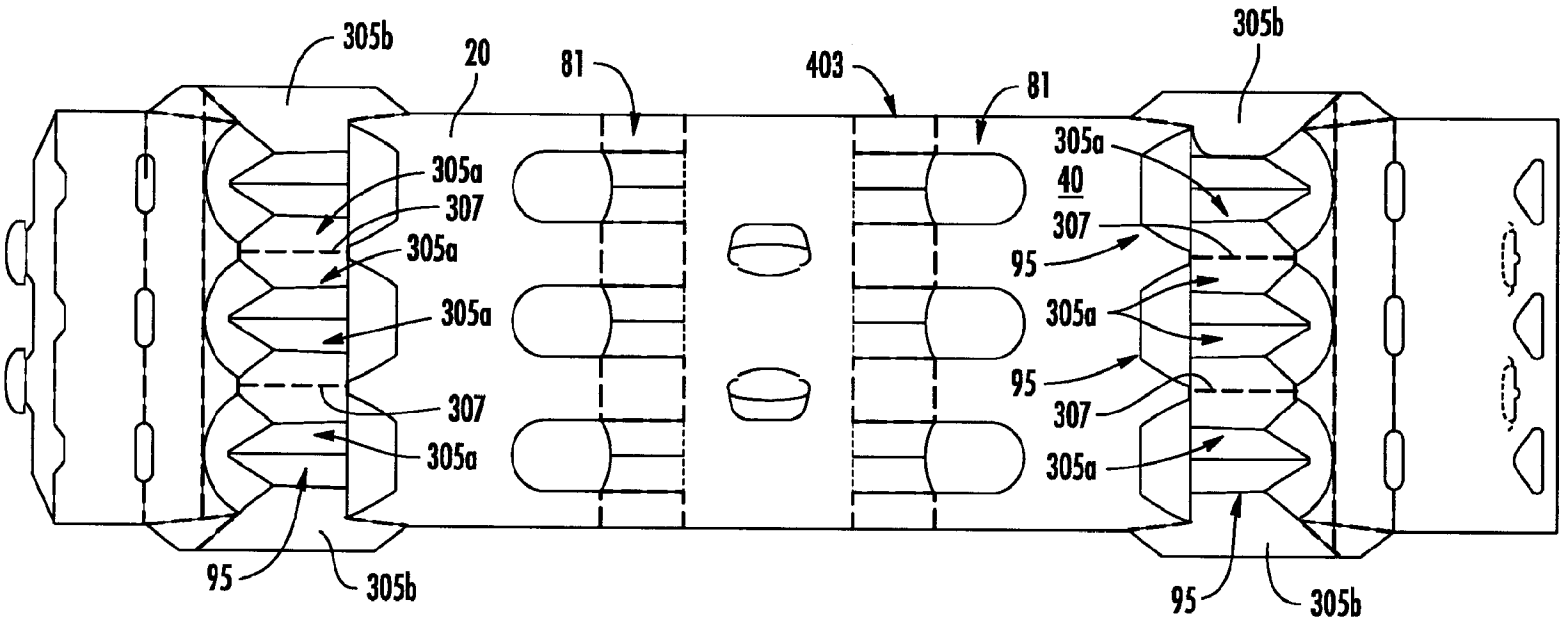
FIG. 7 is a plan view of an exterior surface of a blank for forming a carton according to a fourth embodiment of the disclosure.

FIG. 7 illustrates a blank 403 used to form a carton according to a fourth embodiment of the present disclosure. The fourth embodiment is like the first embodiment shown and described with reference to FIGS. 1-4 and the third embodiment shown and described with reference to FIG. 6, except for variations noted and other variations that would be apparent to one of ordinary skill in the art. In FIG. 7, like reference numbers as to the reference numbers shown in the earlier embodiments indicate like or similar elements. The blank 403 includes upper retention features 81 that are similar or identical to the upper retention features of the first embodiment. The lower retention features 95 of first side panel 20 of the fourth embodiment each include inner retention flaps 305*a* and outer retention flaps 305*b* that are similar to the inner retention flaps and outer retention flaps of the lower retention features of the third embodiment. In the embodiment of FIG. 7, the retention features 95 of the second side panel 40 are similar or identical to the retention features of the first side panel 20.

FIG. 8 illustrates a blank 503 used to form a carton according to a fifth embodiment of the present disclosure. The fifth embodiment is like the first embodiment shown and described with reference to FIGS. 1-4, except for variations noted and other variations that would be apparent to one of ordinary skill in the art. In FIG. 8, like reference numbers as to the reference numbers shown in FIG. 1 indicate like or similar elements. The blank 503 includes upper retention features 81 that are similar or identical to the upper retention features of the first embodiment. The lower retention features 95 of first side panel 20 of the fifth embodiment each include inner retention flaps 505*a* foldably connected at a respective fold line 507 and outer retention flaps 505*b* similar to the inner and outer retention flaps of the previous embodiments. In the embodiment of FIG. 8, the blank 503 comprises a middle retention flap 505*c* that extends from an intermediate portion 97 of a respective side panel 20, 40 and is positioned between respective retention flaps 505*a*, 505*b*. The middle retention flap 505*c* can be placed behind a respective container B in the assembled carton. The retention flaps 505*a*, 505*b* can be outwardly folded relative to the intermediate portion 97 of the side panels 20, 40 to form a cushion between adjacent containers in a similar manner as the retention flaps 105*a*, 105*b* of the first embodiment. In the embodiment of FIG. 8, the retention features 95 of the second side panel 40 are similar or identical to the retention features of the first side panel 20.

Figure 9:
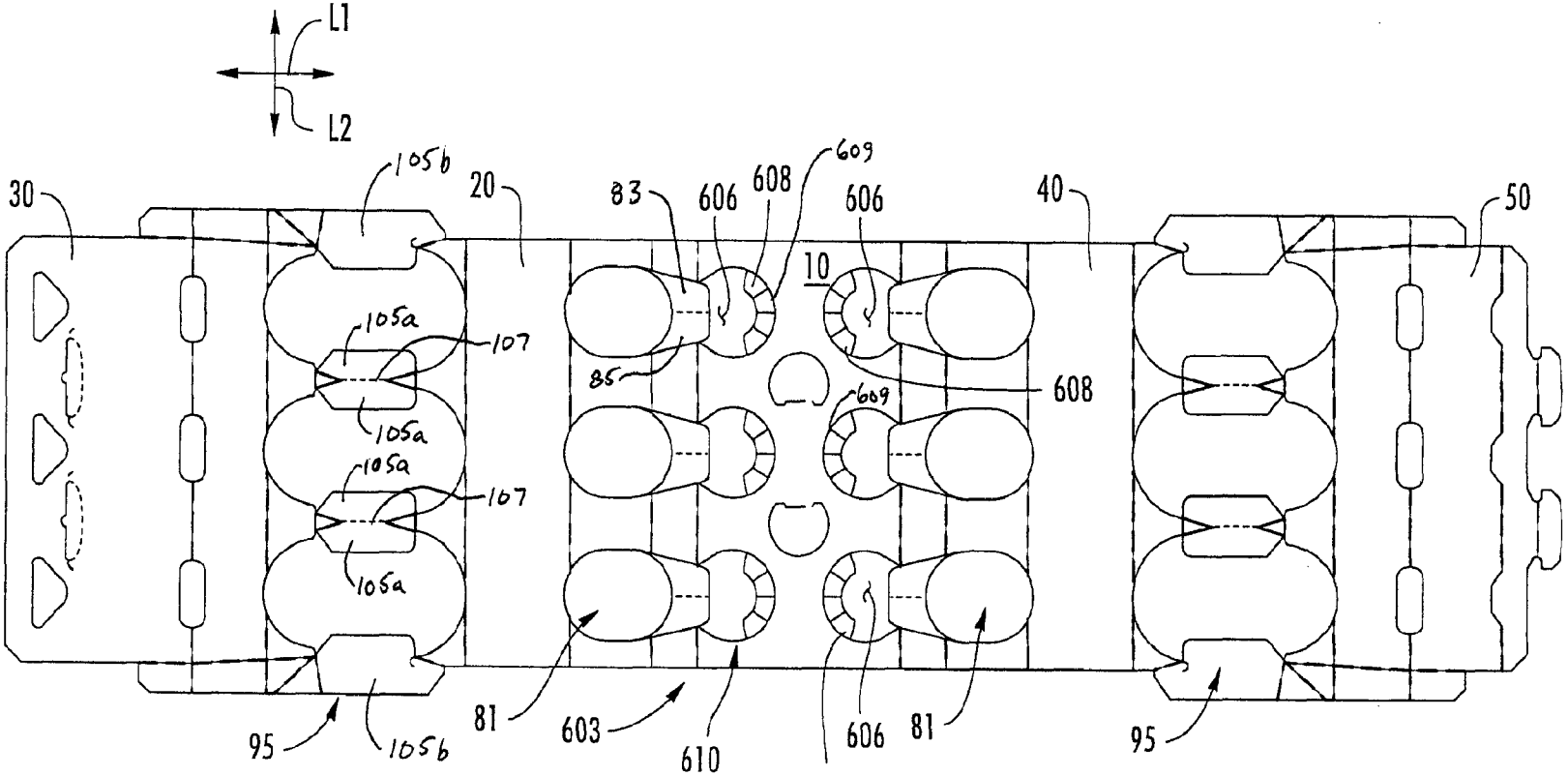
FIG. 9 is a plan view of an exterior surface of a blank for forming a carton according to a sixth embodiment of the disclosure.
Figure 10:
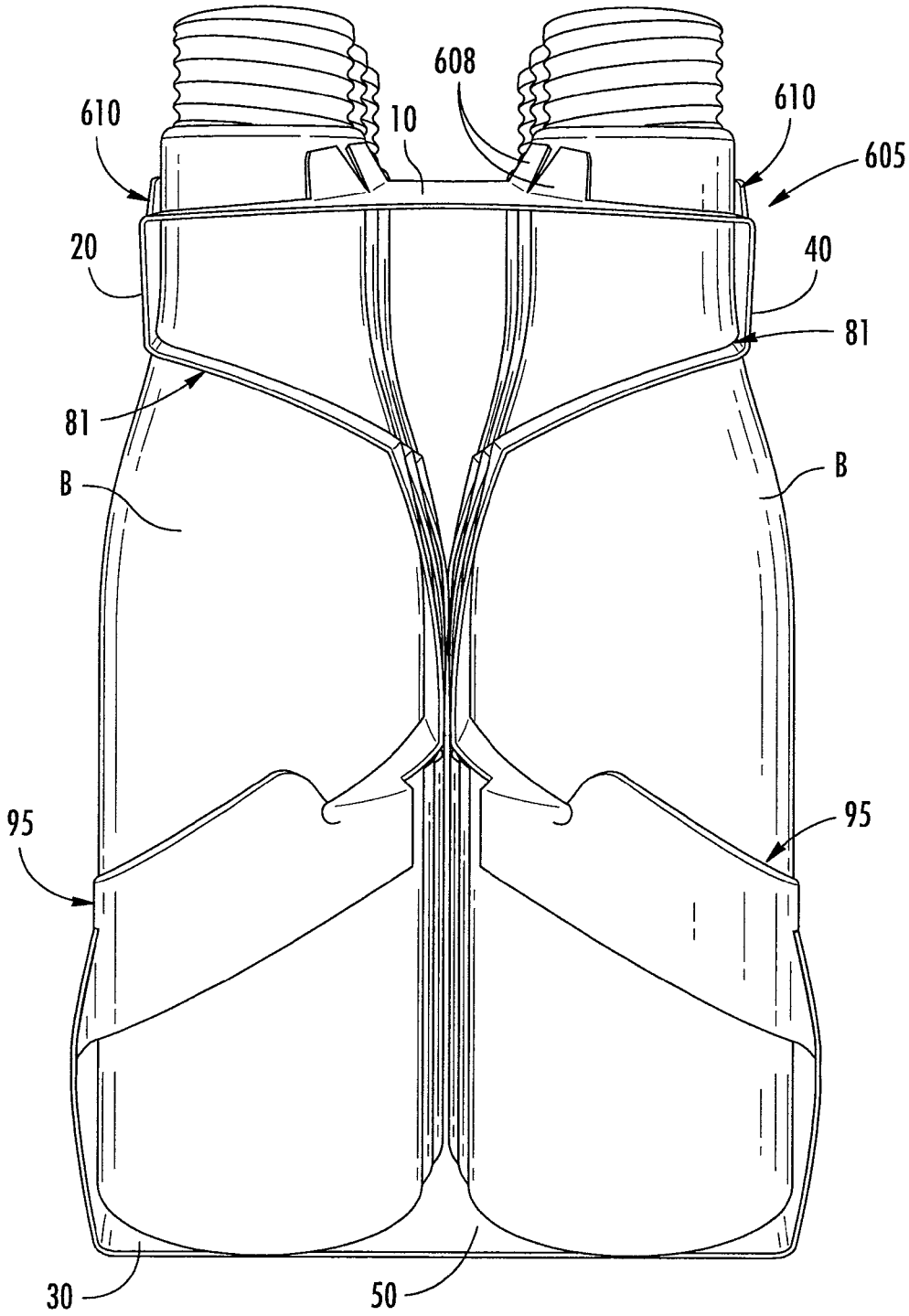
FIG. 10 is an end view of the carton of the sixth embodiment.
Figure 11:
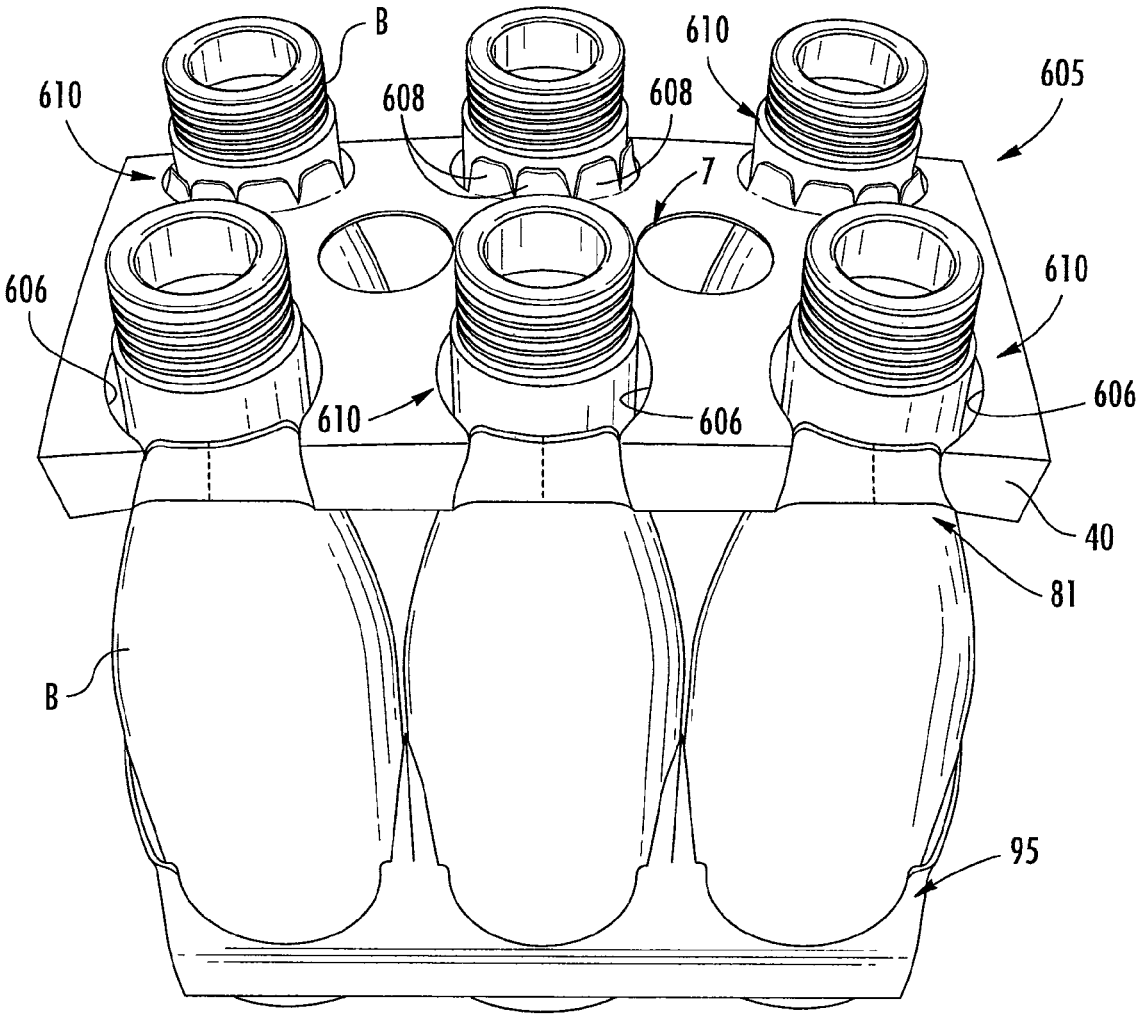
FIG. 11 is a perspective view of the carton of the sixth embodiment.

FIG. 9 illustrates a blank 603 used to form a carton 605 (FIGS. 10-11) according to a sixth embodiment of the present disclosure. The sixth embodiment is like the first embodiment shown and described with reference to FIGS. 1-4, except for variations noted and other variations that would be apparent to one of ordinary skill in the art. In the embodiment of FIGS. 9-11, like reference numbers as to the reference numbers shown in FIG. 1 indicate like or similar elements. The blank 603 includes openings 606 in the top panel 10 that are adjacent the retention features 81 in a respective side panel 20, 40. The retention features 81 of the sixth embodiment comprise flaps 83, 85 that are shaped differently than the flaps of the first embodiment. The openings 606 are top retention features 610 in the top panel 10 that receive a top portion of a respective container B in the carton 605.

In the embodiment of FIGS. 9-11, the top retention features 610 further comprise flaps 608 adjacent the opening 606 in the top panel 10. The flaps 608 are foldably connected to the top panel 10 at an arcuate fold line 609 and can flex to conform to the shape of the top portion of the container B that is received in the opening 606. The flaps 608 are biased against a respective container B to retain the container in a tight fit in the carton 605. The top retention features 610 could comprise features other than the opening 606 and flaps 608, or the opening 606 and flaps 608 could be otherwise shaped, arranged, and/or configured without departing from the disclosure.

As shown in FIGS. 10-11, the carton or carrier 605 can be formed in a similar manner as the carton or carrier of the previous embodiments. On each side of the carton 605, the carton has lower retention features 95, middle retention features 81 that are similar in structure and function as the upper retention features of the previous embodiments, and top retention features 610. The lower retention features 95 and middle retention features 81 are similar to the retention features of the earlier embodiments and are positioned in a respective side panel 20, 40 to retain a bottom portion and a middle portion of a respective container B. The top retention features 610 are positioned in the top panel 10 to retain a top portion of a respective container B that can protrude through the top panel. The carton 605 could be otherwise shaped, arranged, and/or configured without departing from the disclosure.

Figure 12:
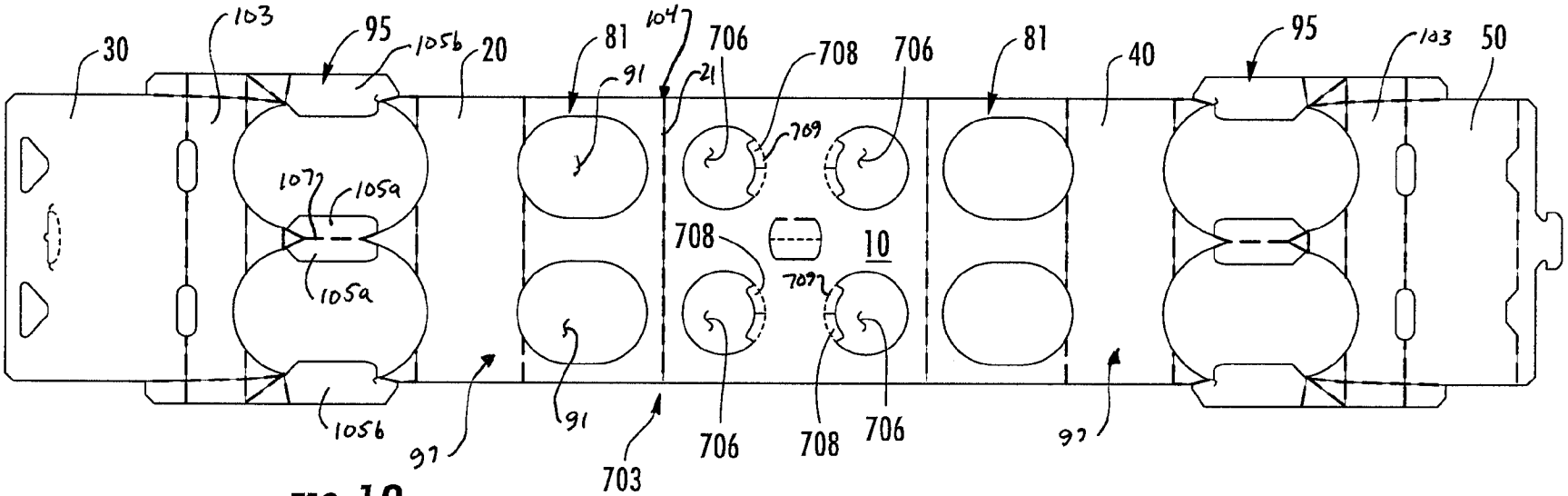
FIG. 12 is a plan view of an exterior surface of a blank for forming a carton according to a seventh embodiment of the disclosure.
Figure 13:
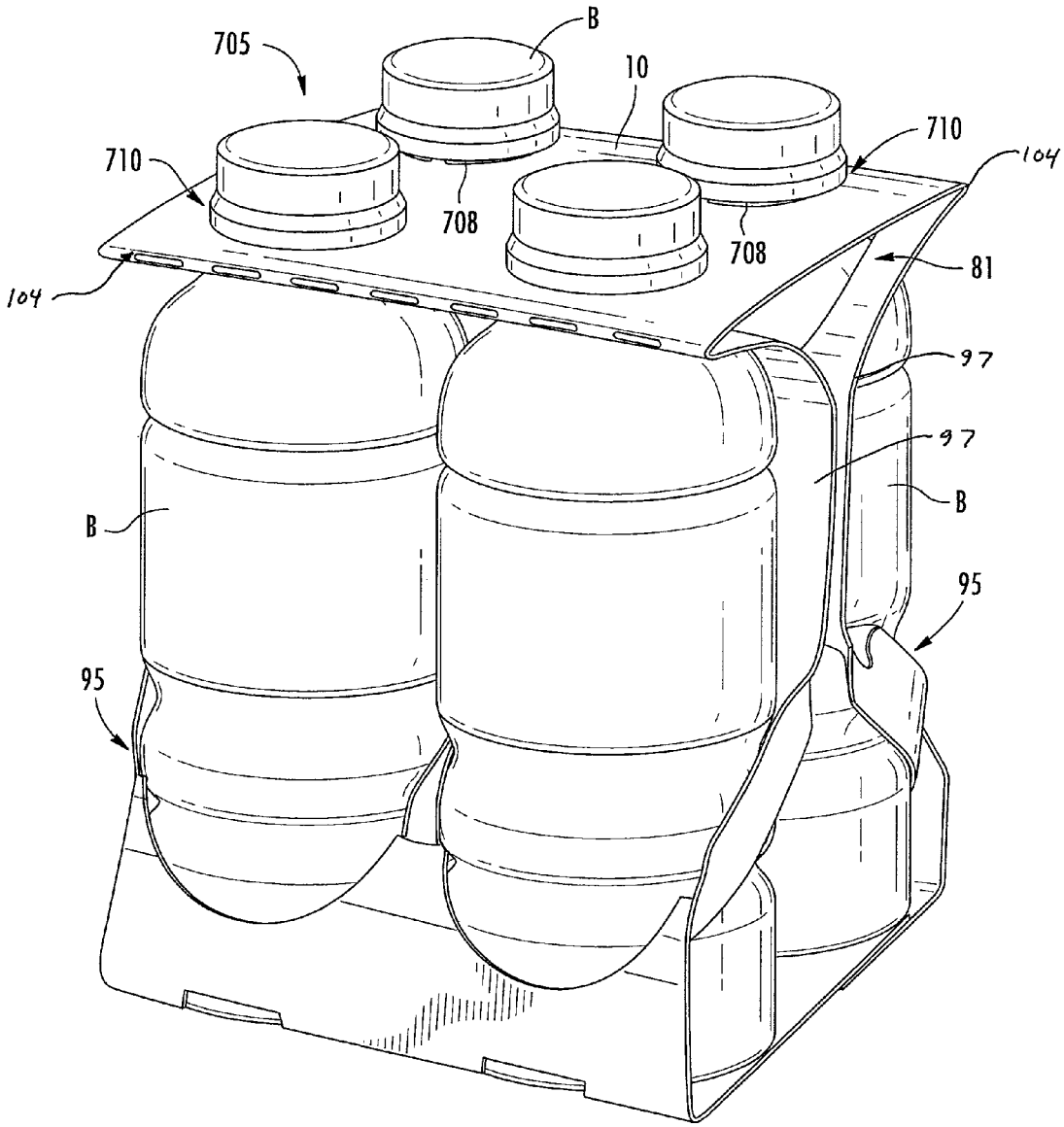
FIG. 13 is a perspective view of the carton of the seventh embodiment.

FIG. 12 illustrates a blank 703 used to form a carton 705 (FIG. 13) according to a seventh embodiment of the present disclosure. The seventh embodiment is like one or more of the previous embodiments, except for variations noted and other variations that would be apparent to one of ordinary skill in the art. In the embodiment of FIGS. 12 and 13, like reference numbers as to the reference numbers shown in FIG. 1 indicate like or similar elements. The carton 705 and blank 703 are sized to hold two containers B on each side of the carton in a 2×2 arrangement, but the carton and/or blank could be otherwise sized to hole more or less than four containers without departing from the disclosure. The blank 703 includes openings 706 in the top panel 10 that are spaced apart from the retention features 81 in a respective side panel 20, 40. In the illustrated embodiment, the retention features 81 comprise openings 91 in a respective side panel 20, 40. The openings 706 in the top panel are top retention features 710 in the top panel 10 that receive a top portion of a respective container B in the carton 705.

In the embodiment of FIGS. 12 and 13, the top retention features 710 further comprise flaps 708 adjacent the opening 706 in the top panel 10. The flaps 708 are foldably connected to the top panel 10 at a curved fold line 709 and can flex to conform to the shape of the top portion of the container B that is received in the opening 706. The top retention features 710 could comprise features other than the opening 706 and flaps 708, or the opening 706 and flaps 708 could be otherwise shaped, arranged, and/or configured without departing from the disclosure.

As shown in FIGS. 12 and 13, the carton or carrier 705 can be formed in a similar manner as the carton or carrier of the previous embodiments. In the embodiment of FIGS. 12 and 13, the top portion 104 of each side panel 20, 40 is minimized such that the upper portion 104 comprises the width of the fold line 21, 41 or line of weakening connecting the top panel 10 with the side panels 20, 40. In the embodiment of FIGS. 12 and 13, the intermediate portion 97 of the side panels 20, 40 are folded under the top panel 10 and have an upper curved portion that extends downward from the top panel and is concavely curved between the upper portion 104 and the lower portion 103 of the side panel 20, 40. As with the previous embodiments, on each side of the carton 705, the carton has lower retention features 95, middle retention features 81 (similar in structure and function as the upper retention features 81 of the previous embodiments), and top retention features 710. The lower retention features 95 and middle retention features 81 are positioned in a respective side panel 20, 40 to retain a bottom portion and a middle portion of a respective container B. The top retention feature 710 is positioned in the top panel 10 to retain a top portion of a respective container B that protrudes through the top panel. The carton 705 could be otherwise shaped, arranged, and/or configured without departing from the disclosure.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines can include: a score line, such as lines formed with a blunt scoring knife, or the like, which creates a crushed portion in the material along the desired line of weakness; a cut that extends at least partially into a material along the desired line of weakness, and/or a series of cuts that extend partially into and/or completely through the material along the desired line of weakness; and various combinations of these features The foregoing description illustrates and describes various embodiments of the present disclosure. As various changes could be made in the above construction, it is intended that all matter contained in the above description or shown in the accompanying drawings shall be interpreted as illustrative and not in a limiting sense. Furthermore, the present disclosure covers various modifications, combinations, alterations, etc., of the above-described embodiments. It will be understood by those skilled in the art that while the present disclosure has been discussed above with reference to exemplary embodiments, various additions, modifications and changes can be made thereto without departing from the spirit and scope of the claims. Furthermore, certain features and characteristics of each embodiment may be selectively interchanged and applied to other illustrated and non-illustrated embodiments without departing from the scope of the disclosure.

What is claimed is:

1. A carton for carrying a plurality of articles, the carton comprises:

a top panel and at least one side panel foldably connected to the top panel, the least one side panel has a first retention feature for retaining a first portion of at least one of the plurality of articles, and a second retention feature for retaining a second portion of the at least one of the plurality of articles, the first retention feature comprising at least two first openings and the second retention feature being spaced apart from the first retention feature, the second retention features comprising at least two second openings respectively aligned with a respective one of the at least two first openings and at least two retention flaps foldably connected at a respective fold line, the at least two retention flaps being positioned between the at least two second openings, the at least two retention flaps are inner retention flaps and the second retention feature comprises at least one outer retention flap, the at least one outer retention flap being foldably connected to the at least one side panel and being adjacent one of the at least two second openings, and the at least one outer retention flap is foldably connected to a tuck-in flap, the tuck in flap being fodably connected to the at least one side panel and being positioned in face-to-face contact with the at least one side panel.

2. The carton of claim 1 wherein the first retention feature is an upper retention feature that is for retaining an upper portion of the at least one of the plurality of articles and the second retention feature is a lower retention feature that is for retaining a lower portion of the at least one of the plurality of articles.

3. The carton of claim 1 further comprising a third retention feature in the top panel, the third retention feature being for retaining a third portion of the at least one of the plurality of articles.

4. The carton of claim 3 wherein the first retention feature is a middle retention feature that is for retaining a middle portion of the at least one of the plurality of articles, the second retention feature is a lower retention feature that is for retaining a lower portion of the at least one of the plurality of articles, and the third retention features is top retention feature that is for retaining a top portion of the at least one of the plurality of articles.

5. The carton of claim 4 wherein the top retention feature comprise at least one top opening in the top panel, the top opening being for receiving a top portion of a respective article.

6. The carton of claim 5 wherein the top retention feature comprises at least two top retention flaps foldably connected to the top panel and adjacent the top opening.

7. The carton of claim 1 wherein the carton has two substantially open ends, and the at least one outer retention flap extends across one of the substantially open ends to retain an article that is adjacent the one of the substantially open ends.

8. The carton of claim 1 wherein the outer retention flap is foldably connected to the at least one side panel at a fold line and is separated from the at least one side panel by a hook cut extending from an end of the fold line.

9. The carton of claim 1 wherein the inner retention flaps each have a base portion and a distal portion foldably connected to the base portion, the base portion of adjacent inner retention flaps being foldably connected.

10. The carton of claim 9 wherein the outer retention flap comprises a base portion and a distal portion foldably connected to the base portion of the outer retention flap.

11. The carton of claim 1 wherein the second retention features further comprise a middle retention flap foldably connected to the at least one side panel, the middle retention flap being behind a respective article of the plurality of article.

12. The carton of claim 1 wherein the first rentention feature comprises at least two dispenser flaps foldably connected to the at least one side panel and positioned adjacent a respective one of the at least two first openings.

13. The carton of claim 1 wherein the at least one side panel comprises a first side panel and a second side panel, the carton further comprises a bottom panel foldably connected to at least one of the first side panel and the second side panel, each of the first side panel and the second side panel comprises an upper portion, a lower portion, and an intermediate portion extending between the upper portion and the lower portion, each respective intermediate portion of each of the first and second side panels being concavely curved between the upper and lower portions.

14. The carton of claim 13 wherein the intermediate portion of the first side panel is in contact with the intermediate portion of the second side panel at a middle of the carton.

15. The carton of claim 13 wherein tops of respective articles are contained in an upper interior of the carton that is formed by the upper portion of a respective first and second side panel and the top panel, an interior surface of the top panel being adjacent the tops of the respective articles.

16. The carton of claim 15 wherein bottoms of respective articles are contained in a lower interior of the carton that is formed by the lower portion of a respective first and second side panel and the bottom panel, the interior surface of the bottom panel being adjacent the bottoms of respective articles.

17. A blank for forming a carton for carrying a plurality of articles, the blank comprising:

a top panel; and at least one side panel foldably connected to the top panel, the least one side panel having a first retention feature for retaining a first portion of at least one of the plurality of articles in the carton formed from the blank, and a second retention feature for retaining a second portion of the at least one of the plurality of articles in the carton formed from the blank, the first retention feature comprising at least two first openings and the second retention feature being spaced apart from the first retention feature, the second retention feature comprising at least two second openings respectively aligned with a respective one of the at least two first openings, and at least two retention flaps foldably connected at a respective fold line, the at least two retention flaps being positioned between the at least two second openings, the retention flaps are inner retention flaps and the second retention feature comprises at least one outer retention flap, the at least one outer retention flap being foldably connected to the at least one side panel and being adjacent one of the at least two second openings, the at least one outer retention flap is foldably connected to a tuck-in flap, the tuck in flap being foldably connected to the at least one side panel and for being positioned in face-to-face contact with the at least one side panel in the carton formed from the blank.

18. The blank of claim 17 wherein the first retention feature is an upper retention feature that is adjacent the top panel for retaining an upper portion of the at least one of the plurality of articles in the carton formed from the blank and the second retention feature is a lower retention feature that is for retaining a lower portion of the at least one of the plurality of articles in the carton formed from the blank.

19. The blank of claim 17 further comprising a third retention feature in the top panel, the third retention feature comprises at least one top opening in the top panel and at least two top retention flaps foldably connected to the top panel and adjacent the top opening, the third retention feature being for receiving and retaining a top portion of a respective article in the carton formed from the blank.

20. The blank of claim 17 wherein the outer retention flap is foldably connected to the at least one side panel at a fold line and is separated from the at least one side panel by a hook cut extending from an end of the fold line.

21. The blank of claim 17 wherein the inner retention flaps each have a base portion and a distal portion foldably connected to the base portion, the base portion of adjacent inner retention flaps being foldably connected.

22. The blank of claim 17 wherein the first retention feature comprises at least two dispenser flaps foldably connected to the at least one side panel and positioned adjacent a respective one of the at least two first openings.

23. A method of forming a carton for carrying a plurality of articles, the method comprising:

obtaining a blank comprising a top panel and at least one side panel foldably connected to the top panel, the least one side panel having a first retention feature for retaining a first portion of a respective article of the plurality of articles, and a second retention feature for retaining a second portion of a respective article of the plurality of articles, the first retention feature comprising at least two first openings and the second retention feature being spaced apart from the first retention feature, the second retention feature comprising at least two second openings respectively aligned with a respective one of the at least two first openings, and at least two retention flaps foldably connected at a respective fold line, the at least two retention flaps being positioned between the at least two second openings;

forming the blank into the carton by positioning the side panel relative to the top panel;

the forming the carton comprising placing a respective article in a respective one of the at least two first openings and the aligned at least two second openings such that each respective article is retained by the first retention feature and the second retention feature, the at least two retention flaps being positioned between the at least two articles, the at least two retention flaps are inner retention flaps and the second retention feature comprises at least one outer retention flap, the at least one outer retention flap being foldably connected to the at least one side panel and being adjacent one of the at least two second openings, the at least one outer retention flap is foldably connected to a tuck-in flap, the tuck-in flap being foldably connected to the at least one side panel, the forming the carton comprising positioning the tuck-in flap in face-to-face contact with the at least one side panel.

24. The method of claim 23 wherein the first retention feature is an upper retention feature that retains an upper portion of the at least two articles and the second retention feature is a lower retention feature that retains a lower portion of the at two articles.

25. The method of claim 23 further comprising a third retention feature in the top panel, the third retention retains a third portion of a respective article.

26. The method of claim 25 wherein the first retention feature is a middle retention feature that retains a middle portion of a respective article, the second retention feature is a lower retention feature that retains a lower portion of a respective article, and the third retention features is top retention feature that retains a top portion of a respective article.

27. The method of claim 26 wherein the top retention feature comprise at least one top opening in the top panel, the forming the blank into the carton comprises placing a top portion of a respective article through the at least one top opening.

28. The method of claim 27 wherein the top retention feature comprises at least two top retention flaps foldably connected to the top panel and adjacent the top opening.

29. The method of claim 23 wherein forming the carton comprises forming two substantially open ends, and positioning the at least one outer retention flap to extend across one of the substantially open ends to retain an article that is adjacent the one of the substantially open ends.

30. The method of claim 23 wherein the second retention features further comprise a middle retention flap foldably connected to the at least one side panel, the forming the carton comprising positioning the middle retention flap being behind a respective article.

31. The method of claim 23 wherein the at least one side panel comprises a first side panel and a second side panel, the blank further comprises a bottom panel foldably connected to at least one of the first side panel and the second side panel, each of the first side panel and the second side panel comprises an upper portion, a lower portion, and an intermediate portion extending between the upper portion and the lower portion, the forming the carton comprises positioning each respective intermediate portion of each of the first and second side panels to be concavely curved between the upper and lower portions.

32. The method of claim 31 wherein the forming the carton comprises positioning the intermediate portion of the first side panel in contact with the intermediate portion of the second side panel at a middle of the carton.

33. The method of claim 31 wherein the forming the carton comprises forming an upper interior of the carton with the upper portion of a respective first and second side panel and the top panel, and positioning the tops of respective articles in the upper interior of the carton such that an interior surface of the top panel is adjacent the tops of the respective articles.

34. The method of claim 33 wherein the forming the carton comprises forming a lower portion of the carton with the lower portion of a respective first and second side panel and the bottom panel, and positioning the bottoms of respective articles in the lower interior of the carton such that the interior surface of the bottom panel is adjacent the bottoms of respective articles.

* * * * *